US008671867B1

(12) United States Patent
Emch

(10) Patent No.: US 8,671,867 B1
(45) Date of Patent: Mar. 18, 2014

(54) CONSTRUCTION BARGE

(75) Inventor: Jeffrey J. Emch, Butler, IN (US)

(73) Assignee: Mid-America Foundation Supply Inc., Fort Wayne, IN (US)

( * ) Notice: Subject to any disclaimer, the term of this patent is extended or adjusted under 35 U.S.C. 154(b) by 86 days.

(21) Appl. No.: 13/285,634

(22) Filed: Oct. 31, 2011

(51) Int. Cl.
*B63B 35/44* (2006.01)

(52) U.S. Cl.
USPC ..... 114/266; 114/77 R; 114/267

(58) Field of Classification Search
USPC ..... 114/26, 28, 74 R, 77 A, 77 R, 264, 267, 114/352, 266; 405/205, 206
See application file for complete search history.

(56) References Cited

U.S. PATENT DOCUMENTS 2,604,866 A * 7/1952 Wyland ..... 114/26
2,605,733 A * 8/1952 Smith ..... 114/267
2,847,961 A * 8/1958 Meckenstock ..... 114/26
3,057,315 A * 10/1962 Robishaw ..... 114/26
4,011,826 A 3/1977 Yee
5,613,339 A 3/1997 Pollock
8,079,320 B1 12/2011 Suriani
2009/0283025 A1 11/2009 Bigler et al.

OTHER PUBLICATIONS

Poseidon Barge Corporation Brochure, prior to Nov. 3, 2008.
Shugart Barges Product Brochure, at least as early as Oct. 30, 2011.
Shugart Manufacturing, Product Brochure, 2003.

* cited by examiner

*Primary Examiner* — Lars A Olson
(74) *Attorney, Agent, or Firm* — Faegre Baker Daniels LLP

(57) ABSTRACT

A construction barge having a body with a generally rectilinear configuration, including two substantially vertical side walls and two substantially vertical end walls, together with a top support platform and a bottom platform. The top and bottom platforms may be made of a rigid, yet relatively lightweight construction including a plurality of elongate roll-formed metal sections connected to one another. The side and end walls each include a pair of vertically-spaced connection angles each having a horizontal flange with a plurality of spaced openings. The dimensions of the barge and the configuration of the connection arrangement are designed such that the barge may have a reduced size and/or weight compared to existing barges, yet may be connected to existing barges while floating in a body of water with the top support platforms of the barges properly aligned.

19 Claims, 14 Drawing Sheets

CONSTRUCTION BARGE

BACKGROUND

1. Field of the Invention

The present invention relates to sectional construction barges of the type used for supporting construction equipment and/or other materials on a body of water.

2. Description of the Related Art

Sectional construction barges are commonly used to support construction equipment, such as cranes, construction tools, and building materials on a body of water during construction projects that are located in or near inland rivers or lakes, for example. The barges typically have a rectilinear configuration with a top support platform, a bottom platform, a pair of end walls, and a pair of side walls.

The barges are typically transported by semi-trailer trucks to a point of use, where cranes are used to place the barges in a body of water. The barges are then moved and aligned with one another in the body of water using tow or pull cables, for example, and are then connected to one another to form a substantially continuous platform for supporting construction equipment and building materials.

The barges may be connected to one another by a connection system in which the side and/or end walls of each barge include a pair of vertically spaced, elongate connection angles having horizontal flanges which are brought into overlapping relationship with similar flanges of an adjacent barge. A plurality of pins are then inserted through aligned openings in the overlapping sets of the upper and lower flanges.

One commonly used known barge weighs at least 26,000 lbs, or even more typically at least 27,000 lbs. The barge has an overall width dimension of about 10 feet, more particularly 10 feet and 4 inches as measured center-to-center between the connecting openings of the connection angles on its opposite sides, and an overall length dimension of about 41 feet, more particularly 41 feet and 4 inches as measured center-to-center between the connecting openings of the connection angles on its opposite ends. The barge has an overall depth dimension of 60.5 inches, as measured between its top and bottom platforms, which are formed of sheets of solid steel. The weight of this barge necessitates that only a single barge may be carried on a standard "lowboy" or flatbed-type trailer of a semi-trailer truck, which typically has a payload limit of 48,000 pounds.

A number of these barges are currently in use, and many contractors have an existing, and sometimes aging, inventory of such barges.

What is needed is a new construction barge that is an improvement over the foregoing.

SUMMARY

The present invention provides a construction barge having a body with a generally rectilinear configuration, including two substantially vertical side walls and two substantially vertical end walls, together with a top support platform and a bottom platform. The top and bottom platforms may be made of a rigid, yet relatively lightweight construction including a plurality of elongate roll-formed metal sections connected to one another. The side and end walls each include a pair of vertically-spaced connection angles each having a horizontal flange with a plurality of spaced openings. The dimensions of the barge and the configuration of the connection angles are designed such that the barge may have a reduced size and/or weight compared to existing barges, yet may be connected to existing barges while floating in a body of water with the top support platforms of the barges properly aligned.

In one form thereof, the present invention provides a sectional barge for supporting construction equipment in a body of water, including a body having a rectilinear configuration with two substantially vertical side walls and two substantially vertical end walls; a top support platform formed of a plurality of elongate sections each comprising a top surface and a bottom surface defining a thickness therebetween, with at least one tubular channel disposed between the top and bottom surfaces; a bottom support platform formed of a plurality of elongate sections each comprising a top surface and a bottom surface defining a thickness therebetween, with at least one tubular channel disposed between the top and bottom surfaces; the side walls and the end walls each having a pair of vertically spaced, horizontally extending flanges extending from outer surfaces of the side walls and the end walls, each flange having a plurality of spaced openings.

In another form thereof, the present invention provides a sectional barge for supporting construction equipment in a body of water, including a body having a rectilinear configuration with two substantially vertical side walls and two substantially vertical end walls; a top support platform having a top surface; a bottom support platform having a bottom surface; at least one of the side wall and the end walls including an upper flange and a lower flange, the flanges vertically spaced from one another, a distance between a centerline of the lower flange and the bottom surface being 4 inches or less.

In a further form thereof, the present invention provides a sectional barge assembly disposed within a body of water for supporting construction equipment, the barge assembly including a first barge having a body of a rectilinear configuration with two substantially vertical side walls and two substantially vertical end walls, a top support platform having a top surface, a bottom support platform having a bottom surface, a first vertical dimension defined between the top and bottom surfaces of the first barge, and at least one of the side walls and the end walls including an upper flange and a lower flange, the flanges vertically spaced from one another; a second barge having a body of a rectilinear configuration with two substantially vertical side walls and two substantially vertical end walls, a top support platform having a top surface, a bottom support platform having a bottom surface, a second vertical dimension defined between the top and bottom surfaces of the second barge, the second vertical dimension less than the first vertical dimension, and at least one of the side walls and the end walls including an upper flange and a lower flange, the flanges vertically spaced from one another; the first and second barges connected to one another with a pair of the upper and lower flanges of the first barge disposed in an overlapping relationship with a respective pair of the upper and lower flanges of the second barge and a plurality of pins extending through aligned openings in the flanges, the top surfaces of the first and second barges substantially horizontally aligned and the bottom surfaces of the first and second barges vertically spaced from one another.

In a still further form thereof, the present invention provides a method of assembling a sectional barge assembly in a body of water for supporting construction equipment, the method including the steps of providing, in a body of water, a first barge having a body of a rectilinear configuration with two substantially vertical side walls and two substantially vertical end walls, a top support platform having a top surface, a bottom support platform having a bottom surface, a first vertical dimension defined between the top and bottom surfaces of the first barge, and at least one of the side walls and the end walls including an upper flange and a lower flange, the flanges vertically spaced from one another; and a second barge having a body of a rectilinear configuration with two substantially vertical side walls and two substantially vertical end walls, a top support platform having a top surface, a bottom support platform having a bottom surface, a second vertical dimension defined between said top and bottom surfaces of the second barge, the second vertical dimension less than the first vertical dimension, and at least one of the side walls and the end walls including an upper flange and a lower flange, the flanges vertically spaced from one another; moving the first and second barges adjacent one another with the top surfaces of the first and second barges substantially horizontally aligned and the bottom surfaces of the first and second barges vertically spaced from one another, and a pair of upper and lower flanges of the first barge disposed in an overlapping relationship with a respective pair of upper and lower flanges of the second barge; and connecting the first and second barges to one another.

BRIEF DESCRIPTION OF THE DRAWINGS

The above-mentioned and other features of the disclosure, and the manner of attaining them, will become more apparent and will be better understood by reference to the following description of embodiments of the invention taken in conjunction with the accompanying drawings, wherein.

Corresponding reference characters indicate corresponding parts throughout the several views. The exemplifications set out herein illustrate embodiments of the disclosure and such exemplifications are not to be construed as limiting the scope of the invention in any manner.

DETAILED DESCRIPTION

Figure 1:
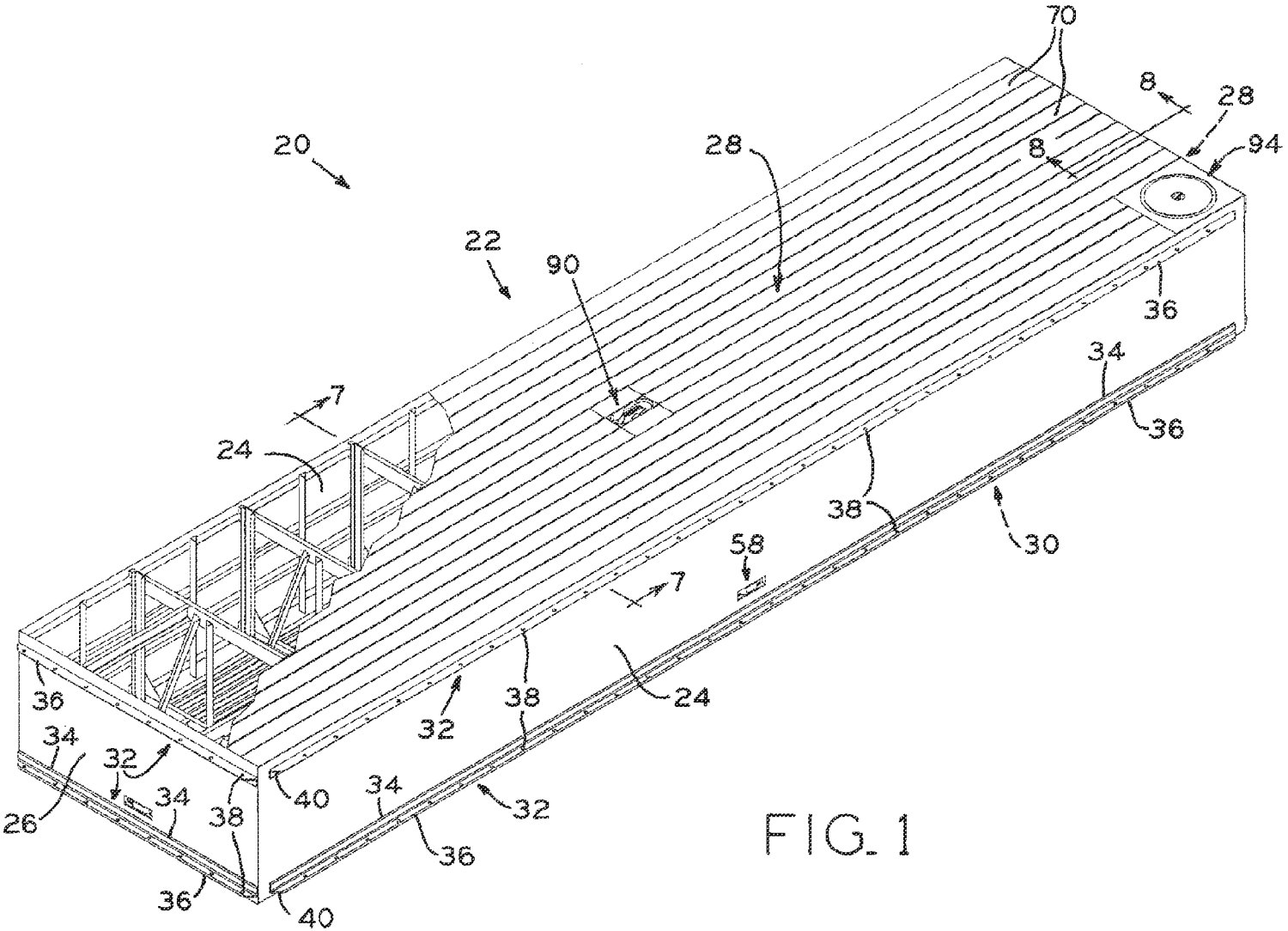
FIG. 1 is a perspective view of a barge according to the present disclosure, with the top support platform partially cut away to show a portion of the internal frame structure.

Referring to FIG. 1, a barge 20 is shown in accordance with the present disclosure. Barge 20 is a sectional construction barge of the type typically used to support construction equipment and/or other materials on a body of water, and includes a body 22 having an overall rectilinear configuration including a pair of substantially vertical side walls 24, a pair of substantially vertical end walls 26, a substantially horizontal top support platform 28, and a substantially horizontal bottom platform 30. The foregoing components are connected and supported by an internal frame structure, described in further detail below, and the components of barge 20 are typically made of pieces of steel which are rolled, bent, roll-formed, etc., as described below and are connected by welding to form body 22 of barge 20 as a watertight structure. Although steel is typically used, other metals or metal alloys and/or rigid plastic materials may also be used.

In FIG. 1, in one embodiment, barge 20 has an overall width dimension W of about 10 feet, and an overall length dimension L of about 41 feet, though such dimensions may vary as desired. As described in further detail below, barge 20 has an overall depth dimension D of 59.5 inches or less, 59.25 inches or less, 59.0 inches or less, 58.75 inches or less, 58.5 inches or less, 58.25 inches or less, or 58.0 inches or less, which is reduced as compared to known barges of similar width and length. Barge 20 has an overall weight of 24,000 lbs or less, such as 23,750 lbs or less, or 23,500 lbs or less, which is also reduced as compared to known barges of similar width and length.

Unless stated otherwise herein, the term "about", when used with overall width "W" and length "L" dimensions, encompasses a deviation (plus or minus) of 5% of any given value, e.g., the term "about 10" encompasses the range 9.5 to 10.5.

Figure 2:
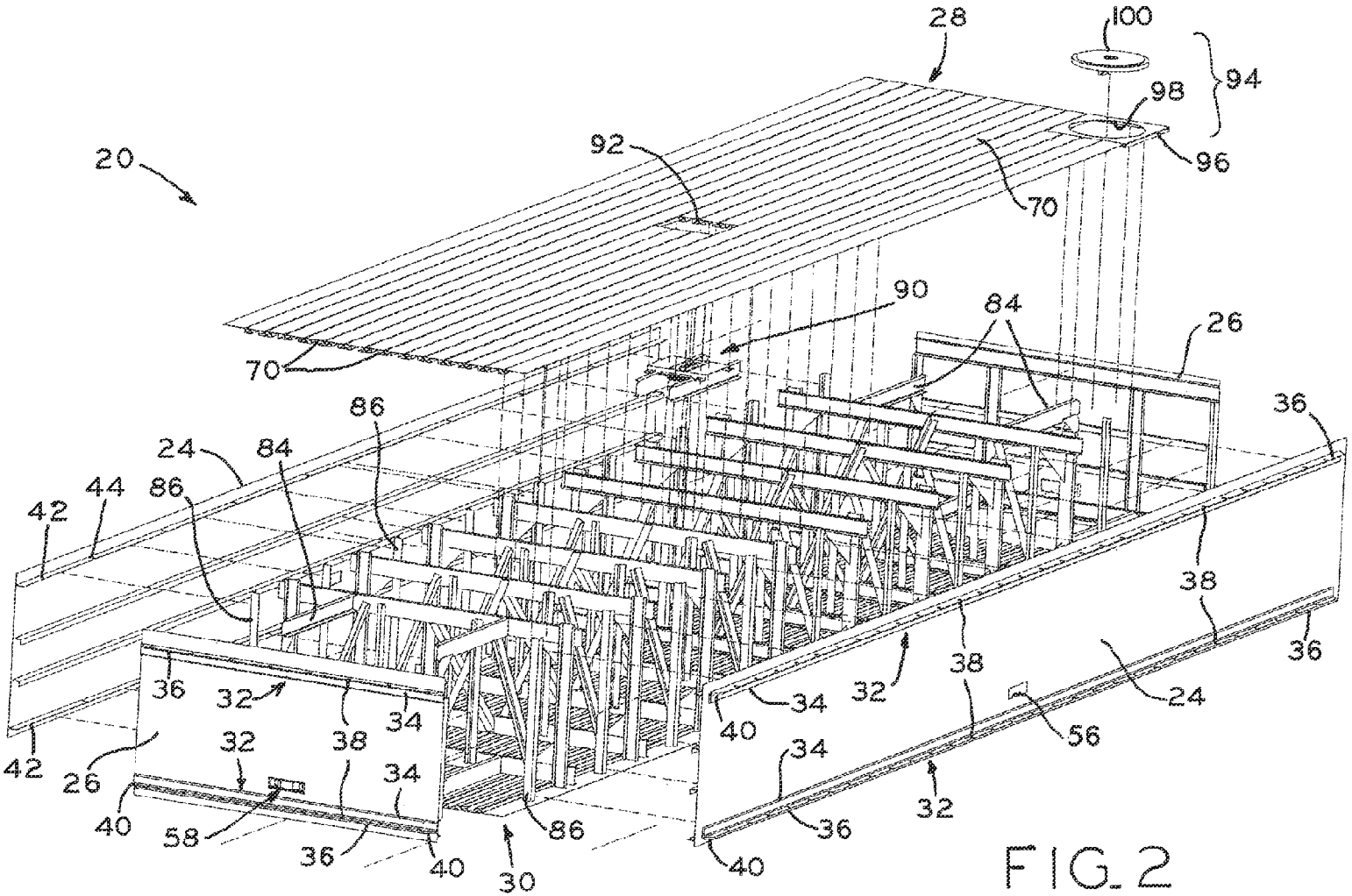
FIG. 2 is an exploded view of the barge.

Referring to FIGS. 1 and 2, each side wall 24 is formed as a sheet of steel, and includes an exterior side having a pair of horizontally extending, vertically spaced 90° connection angles 32 each having vertical flange 34 welded to the exterior side of wall 24, and a horizontal flange 36 extending outwardly of the exterior side of wall 24. Connection angles 32 are shown in FIGS. 7-9 and 11 and described in further detail below. Horizontal flanges 36 each include a plurality of spaced openings 38, with openings 38 in the upper horizontal flange 36 vertically aligned with openings 38 in the lower horizontal flange 36. Horizontal flanges 36 also include chamfers 40 at their ends to avoid sharp corners that could be bent on contact with one another or other objects.

Figure 3:
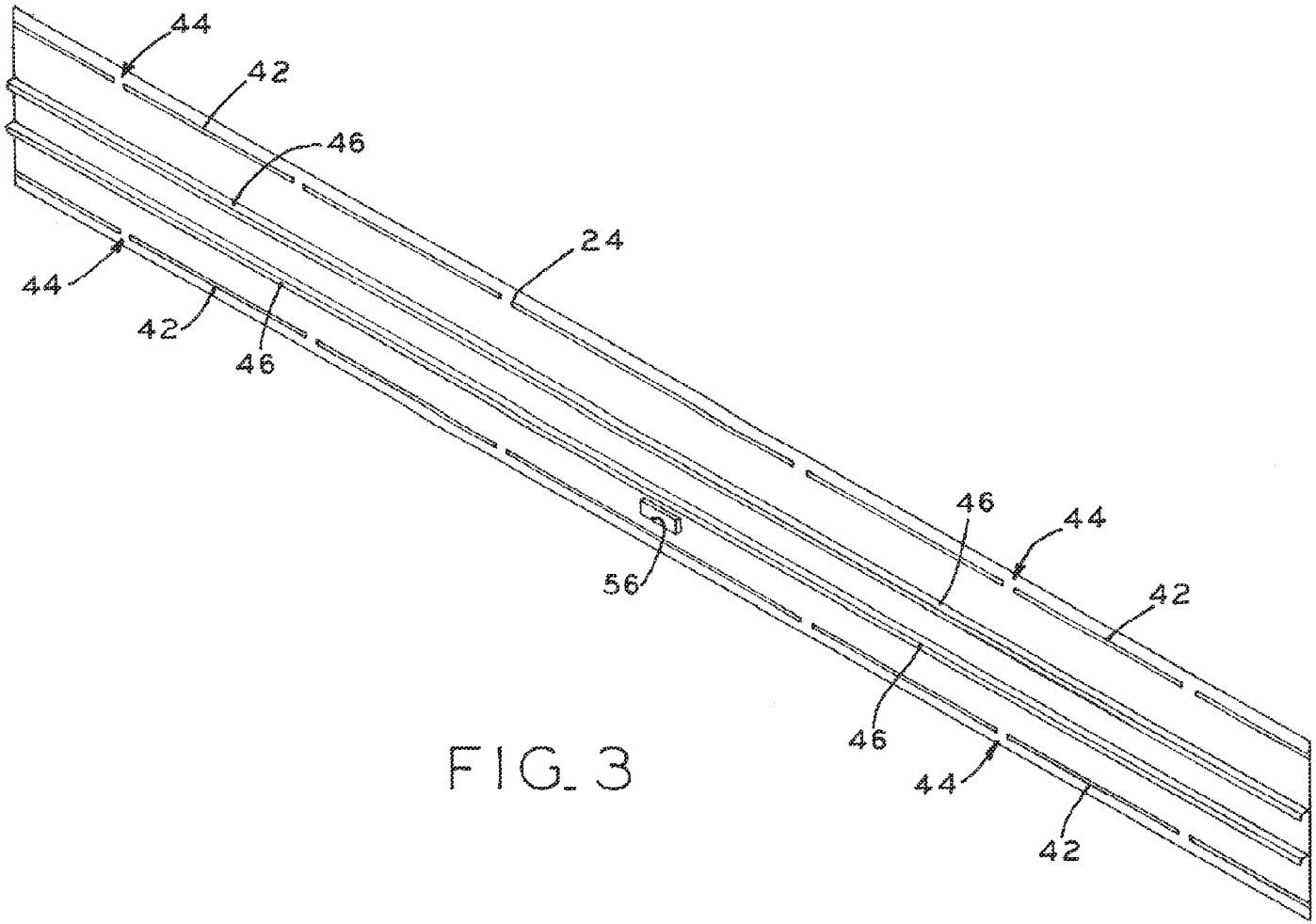
FIG. 3 is a perspective view of the interior side of a side panel.

Referring to FIGS. 2 and 3, the interior side of each side wall 24 includes a pair of upper and lower horizontal flanges 42 disposed proximate the upper and lower edges of side wall 24, respectively. Flanges 42 include spaced notches 44 therealong. A pair of upper and lower angled flanges 46 are disposed between flanges 42.

Referring to FIGS. 1 and 2, each end wall 26 is formed as a sheet of steel and, similar to side walls 24, includes an exterior side having a pair of horizontally extending, vertically spaced 90° connection angles 32 each having vertical flange 34 welded to the exterior side of wall 24, and a horizontal flange 36 extending outwardly of the exterior side of wall 24. Horizontal flanges 36 each include a plurality of spaced openings 38, with openings 38 in the upper horizontal flange 36 vertically aligned with openings 38 in the lower horizontal flange 36. Horizontal flanges 36 also include chamfers 40 at their ends to avoid sharp corners that could be bent on contact with one another or other objects.

Figure 4:
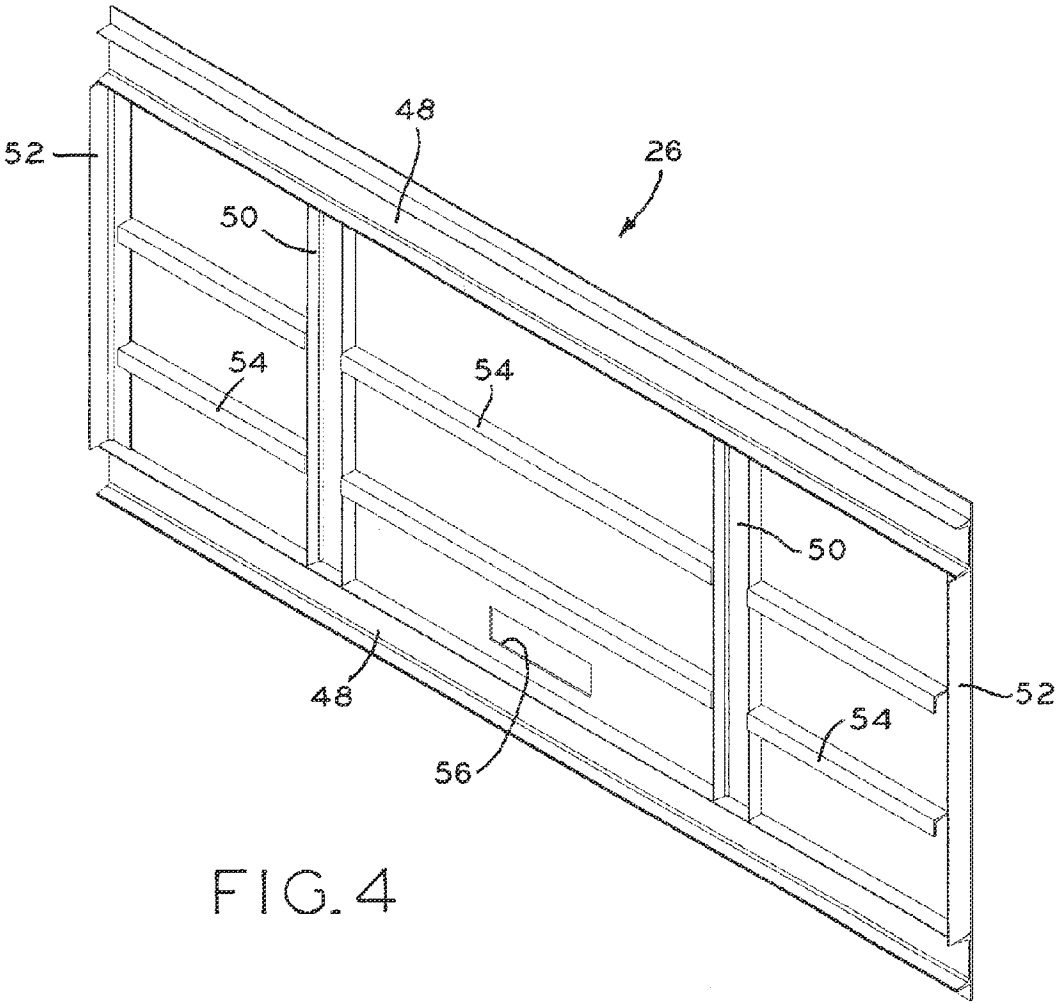
FIG. 4 is a perspective view of the interior side of an end panel.

Referring to FIG. 4, the interior side of each end wall 26 includes a pair of vertically-spaced, upper and lower horizontal C-sections 48 connected centrally by a pair of horizontally-spaced, vertical C-sections 50. A pair of vertical angle flanges 52 are disposed along the sides of the interior of end walls 26, and a plurality of horizontal angled flanges 54 are disposed between vertical C-sections and flanges 52.

Referring to FIGS. 1-4, side walls 24 and end walls 26 each include openings 56 disposed centrally toward the lower portions thereof for receipt of zinc sacrificial anode assemblies 58.

Figure 5:
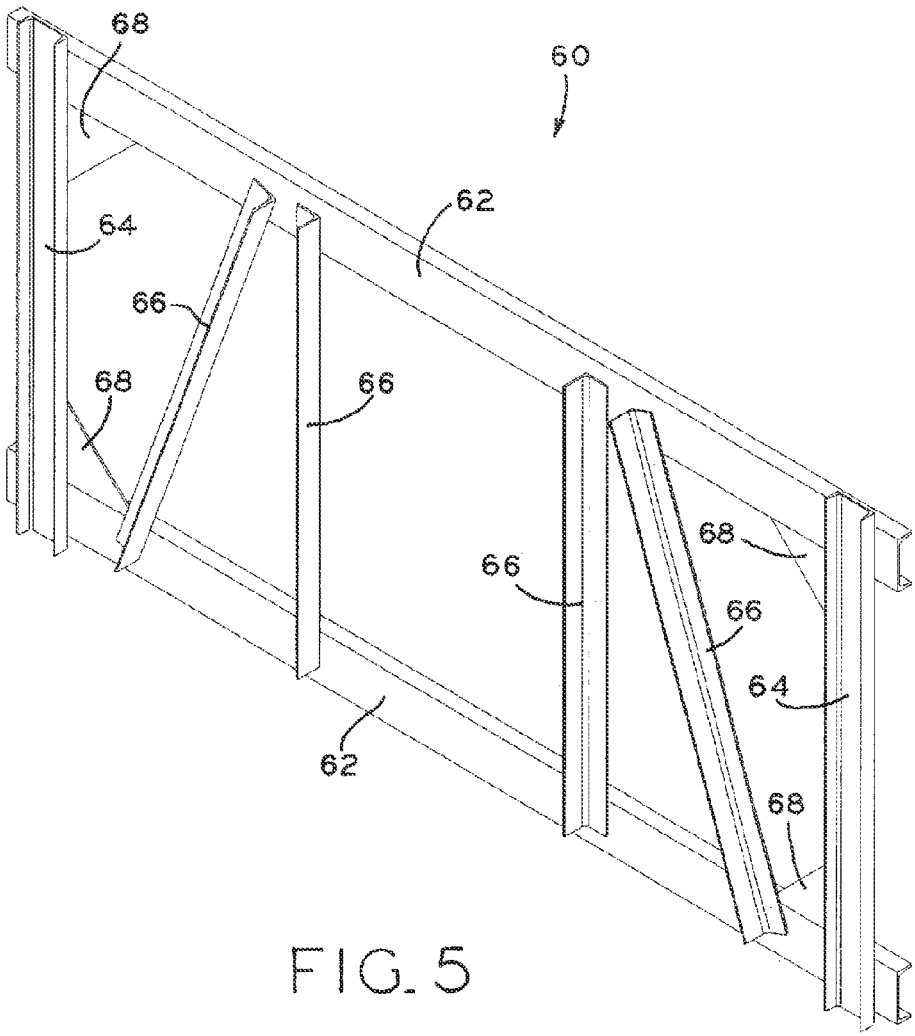
FIG. 5 is a perspective view of an internal truss assembly.

As shown in FIG. 5, each internal truss assembly 60 is formed as a rectangular frame including upper and lower horizontal C-sections 62 and pair of spaced vertical C-sections 64 welded to one another, with the vertical C-sections 64 spaced slightly inwardly from the ends of the horizontal C-sections 62. A series of support angles 66 extend between, and are welded to, the horizontal C-sections to brace the frame structure, and triangular-shaped braces 68 are welded to the corners of the assembly to provide further structural bracing.

Referring to FIGS. 1 and 2, barge 20 includes a top support platform 28 and a bottom platform 30, which define the opposing top and bottom surfaces of barge 20. In one exemplary embodiment, each of top support platform 28 and a bottom platform 30 are formed by a plurality of individual elongate sections 70 of roll-formed steel, shown in cross-section in FIG. 6, which are secured to one another as described below to form top support platform 28 and a bottom platform 30.

Figure 6:
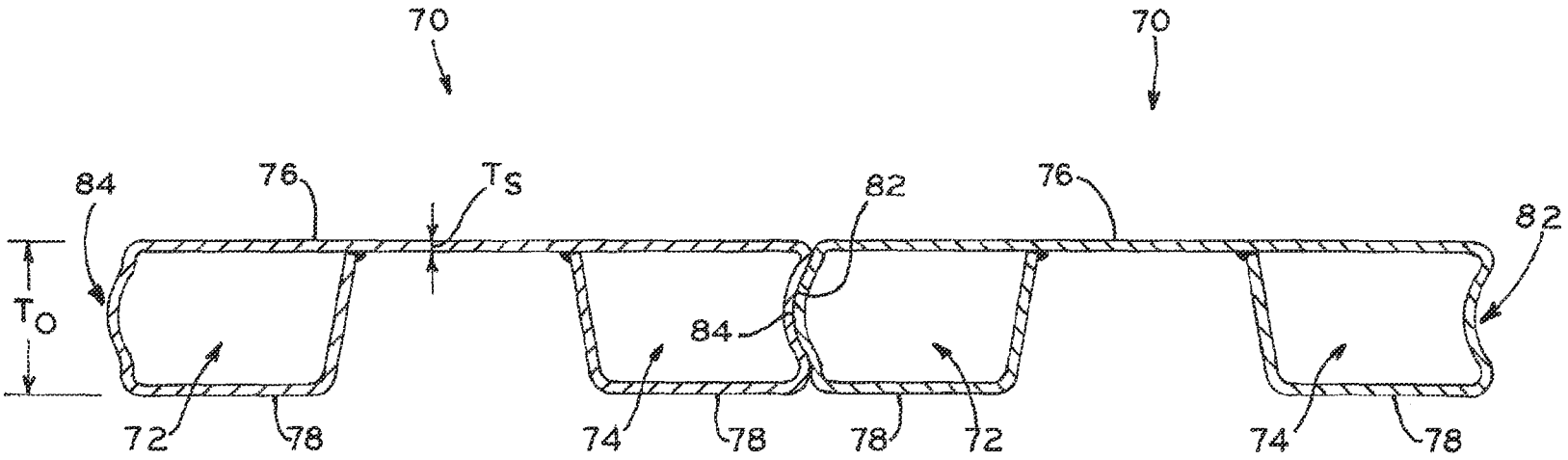
FIG. 6 is a sectional view taken through a pair of elongate sections of the upper and lower platforms of the barge.

Referring to FIG. 6, each elongate section 70 is formed with a pair of tubular channels 72 and 74, and includes a substantially planar upper surface 76 opposite a substantially planar, interrupted lower surface 78. An overall thickness $T_O$ is defined between upper and lower surfaces 76 and 78. A first side of each section 70 includes recess 82 and a second, opposing side of each section 70 includes projection 84. Recesses 82 and projections 84 are aligned with each other as shown in FIG. 6 to facilitate the connection of individual sections 70 to one another. Specifically, a first one of sections 70 is aligned with projection 84 received within recess 82 of a second one of sections 70 to form a joint. Once in the position shown in FIG. 6, the aligned sections 70 may be secured to one another, such as by welding. In order to form top support platform 28 and a bottom platform 30, a plurality of elongate sections 70 are secured to one another, such as in the manner described above, until the desired width and length of platforms 28 and 30 is reached.

In an exemplary embodiment, each individual elongate section 70 is made of roll formed steel having a thickness $T_S$ in FIG. 6 which, due to the roll forming operation by which the shape shown in FIG. 6 is produced, is less than the overall thickness $T_O$ of the section 70. Sections 70 may be formed from hot rolled steel or from steel that is hot rolled, pickled, and oiled. However, other manufacturing processes or techniques may be used to form elongate sections 70, such as extrusion, and sections 70 may be made from other materials such as extruded aluminum. By forming platforms 28 and 30 using elongate sections 70 having the shape shown herein, platforms 28 and 30 of barge 20 are capable of supporting a substantially greater amount of weight than a traditional construction barge. For example, when platforms 28 and 30 are formed from sections 70, barge 20 has a point load capacity as high as 20,000 pounds per square foot, while the support surface of barges made in accordance with traditional techniques have a point load capacity of 1,500 pounds per square foot. Also, the use of sections 70 allows the weight of barge 20 to be significantly reduced, as sections 70 are much lighter for supporting a given load than would be a continuous sheet of steel having a thickness greater than the thickness $T_S$ of the roll formed steel sheet of sections 70.

Referring back to FIG. 1, while not shown in detail, end walls 26 are connected to upper and lower horizontal C-sections 84 extending between the end truss assemblies 60 and end walls 26. Additionally, as best shown in FIGS. 1 and 2, at locations between each of the truss assemblies 60, as well as at locations between the end truss assemblies 60 and end panels 26, interstitial support angles 86 are welded to flanges 42 and 46 of side panels 24 to further support the structure while allowing the overall number of truss assemblies 60 to be reduced, which in turn reduces the overall weight of barge 20.

Figure 7:
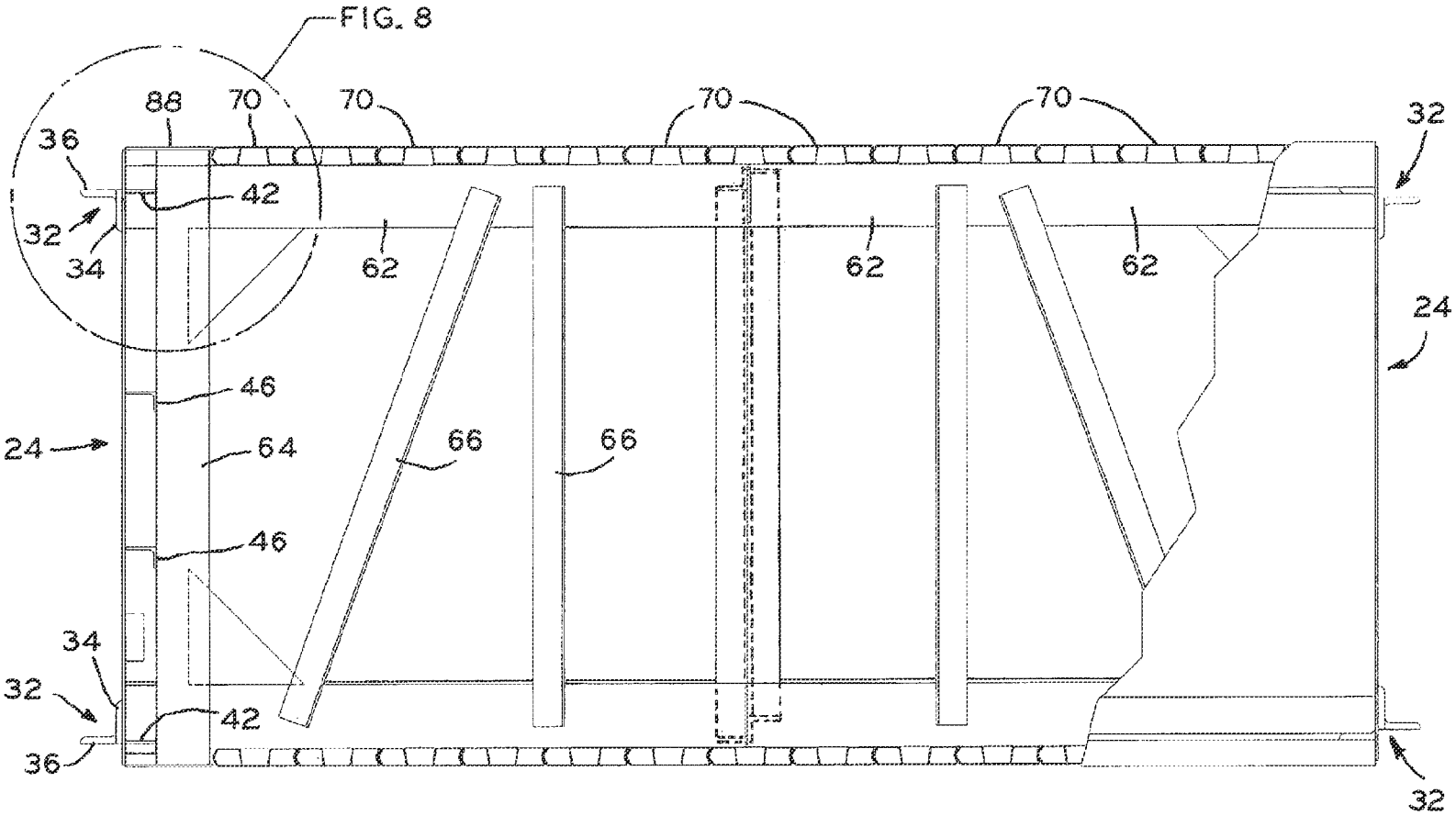
FIG. 7 is a partial sectional view taken along line 7-7 of FIG. 1.
Figure 8:
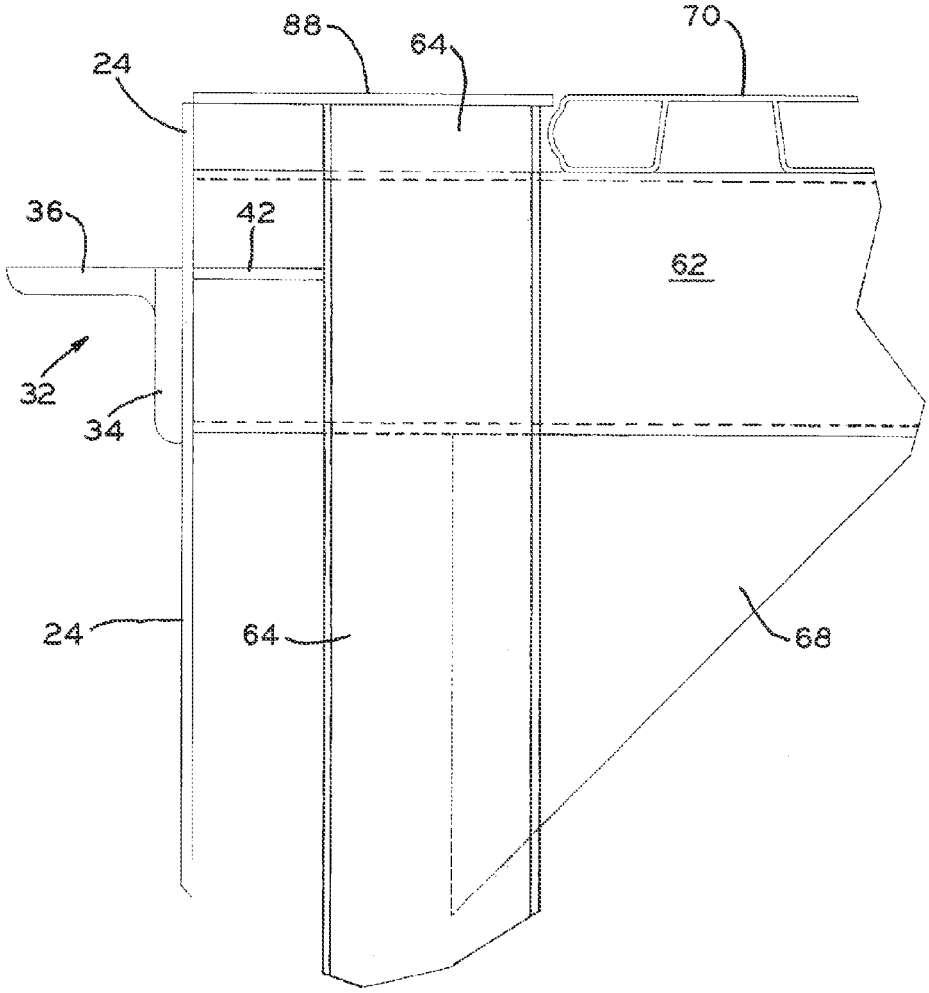
FIG. 8 is a fragmentary view of a portion of FIG. 7, showing the connection between a side panel and the internal frame assembly together with the connection between the top deck structure and the internal frame assembly and side panel.
Figure 9:
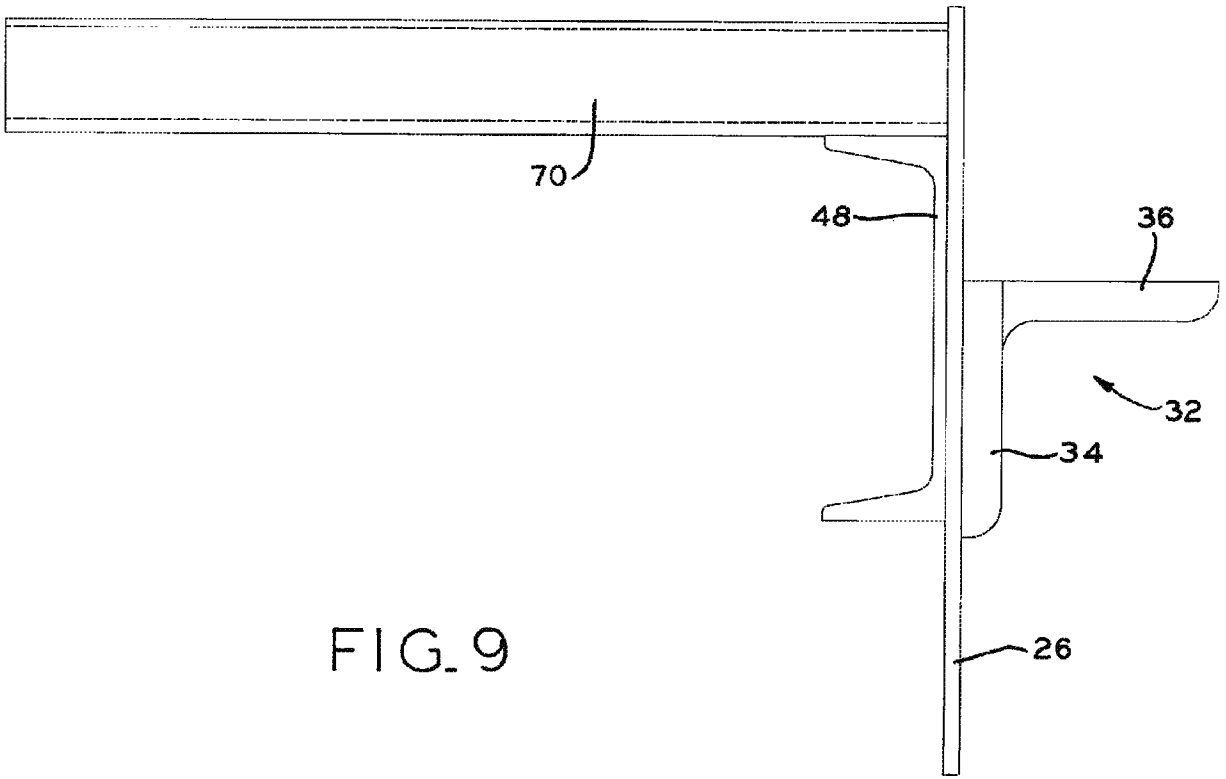
FIG. 9 is a fragmentary sectional view taken along line 8-8 of FIG. 1.

Referring to FIGS. 3, 7 and 8, side walls 24 are connected to internal truss assemblies 60 by a series of welds between vertical C-sections 64 of truss assemblies and flanges 42 and 46 of side walls 24, with notches 44 in flanges 42 of side walls 24 receiving the ends of horizontal C-sections 62 of truss assemblies 60. Elongate sections 70 of top platform 28 rest on the upper flanges of horizontal C-sections 62 of truss assemblies 60 as shown, and a pair of elongate metal side strips 88 extend along the top sides of top support platform 28. Each side strip 88 rests on the top of vertical C-sections 64 of internal truss assemblies 60 and is welded along its opposite side edges to the upper edge of side panel 24 and the edge of an adjacent elongate section 70 to form a watertight connection.

Notably, as best shown in FIGS. 1 and 2, elongate sections 70 and side strips 88 each extend the full length of the top support platform 28 of barge 20 such that separate strips corresponding to side strips 88 are not necessary for use on the ends of top support platform 28 of barge 20. This arrangement is shown in further detail in FIG. 9, in which it may be seen that the ends of elongate sections 70 are supported by, and welded to, the upper flanges of upper C-sections 48 of end walls 26. The ends of elongate sections 70 (and side strips 88) are also welded to the upper edges of end walls 26 to complete the watertight connection. The bottom platform 30 is constructed in the same manner.

Referring to FIG. 2, a lifting clevis assembly 90 is welded between a pair of internal truss assemblies 60 at a centrally disposed location in top support platform 28 which is equidistant between the pair of side walls 24 and between the pair of end walls 26. Clevis assembly 90 is accessible through an opening 92 formed in top support platform 28 and, in use, may be engaged by a crane for lifting barge 20. Advantageously, due to the rectilinear configuration of barge and the central positioning of lifting clevis assembly 90 with respect to the weight distribution of barge 20, barge 20 may be lifted in its entirety by a single crane connection at clevis assembly 90 to deploy barge 20 in a body of water or to remove barge 20 from a body of water.

Still referring to FIGS. 1 and 2, top support platform 28 includes at least one access port assembly 94 including a platform panel 96 welded within a gap which is provided in the sections 70 of upper support platform 28. Platform panel 96 includes an access port or opening 98, together with an access panel 100 removably and sealingly fittable within access opening 98 in a watertight manner. Access opening 98 and access panel 100 are shown as having a circular configuration, though other shapes are possible. Access port assembly 94 allows entry of inspection and/or maintenance personnel into the interior of barge 20.

Figure 10:
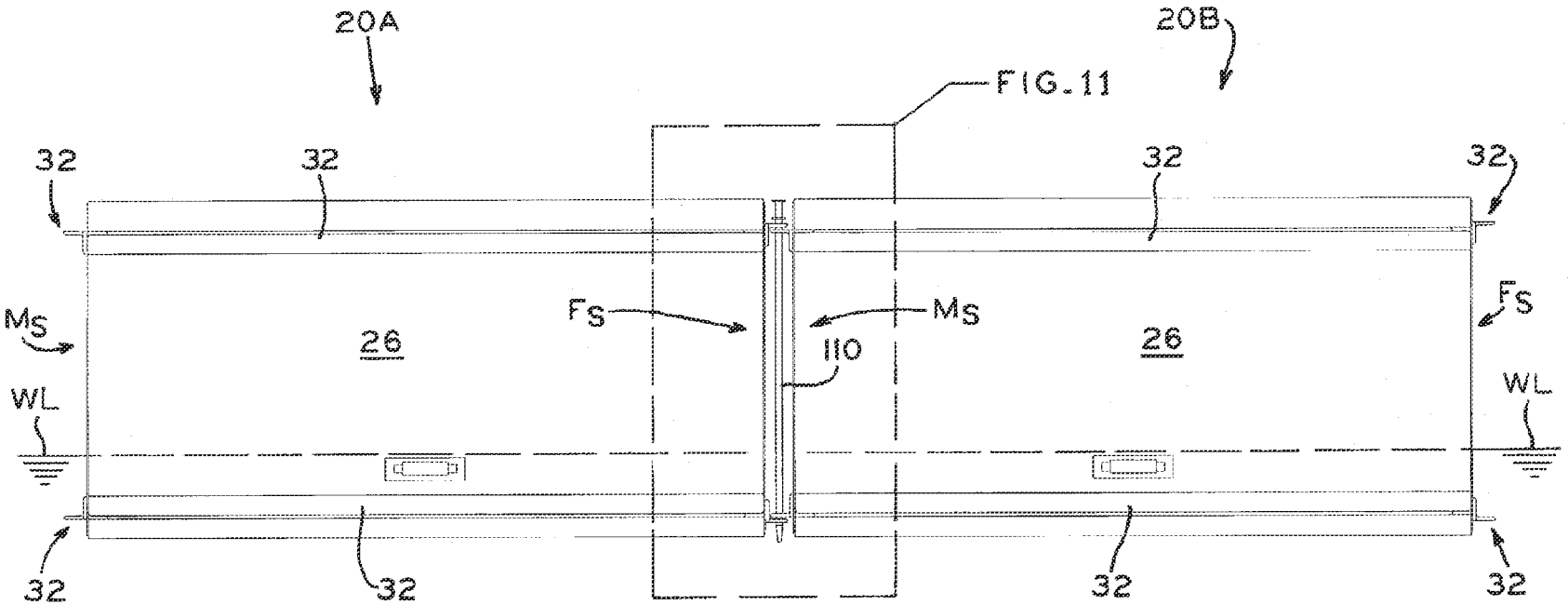
FIG. 10 is an end view of a pair of barges in accordance with the present disclosure connected to one another in a side-by-side relationship while floating in a body of water.
Figure 11:
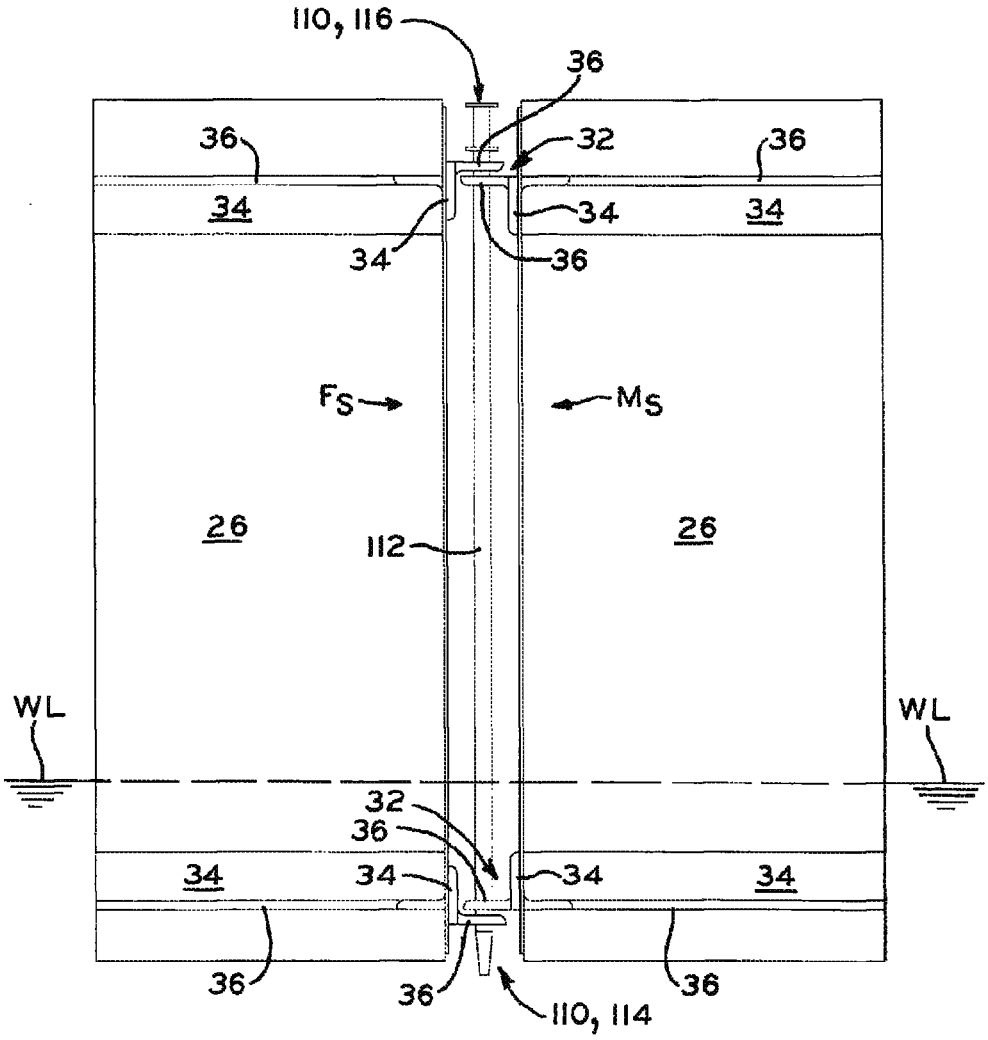
FIG. 11 is a fragmentary view of a portion of FIG. 10.

Referring to FIGS. 10 and 11, a pair of barges in accordance with the present disclosure, including a first barge 20A, shown to the left in FIG. 10, and a second barge 20B, shown to the right in FIG. 10, are shown connected to one another in a side-by-side relationship while floating in a body of water, with the waterline level of the body of water indicated at WL with respect to the barges 20A and 20B.

Each barge 20A and 20B has a male side $M_S$ and an opposite female side $F_S$. As best shown in FIG. 11, at each male side $M_S$, the connection angles 32 are mounted to the side wall 24 of the barge such that the horizontal flanges 36 of the connection angles 32 are disposed at a relatively lesser vertical distance with respect to one another and, at each female side $F_S$, the connection angles 32 are mounted to the side wall 24 of the barge such that the horizontal flanges 36 of the connection angles 32 are disposed at a relatively greater vertical distance with respect to one another. As shown in FIGS. 10 and 11, this arrangement allows the horizontal flanges 36 of connection angles 32 of a male side $M_S$ to be received in between the horizontal flanges 36 of connection angles 32 of a female side $F_S$. The connection angles 32 on the end walls 26 of the barges are arranged in a similar manner, such that the barges each include a male end and an opposite female end.

Once barges 20A and 20B are placed in a body of water and then moved into alignment with one another as shown in FIGS. 10 and 11, the horizontal flanges 36 of the respective connection angles 32 will be in overlapping relationship with one another and, with openings 38 in the horizontal flanges 36 also aligned, a series of pins 110 are inserted vertically through the aligned openings 38 in the corresponding sets of connection angles 32 to secure the barges 20A and 20B together. Pins 110 are shown in detail in FIG. 11, and each generally include a shaft 112 having a tapered lead-in distal end 114, and a proximal end including head 116 which is configured for grasping by a user when inserting and/or withdrawing the pin 110.

Typically, the side walls 24 and/or end walls 26 of the barges will be connected using a relatively large number of pins 110, with a pin 110 received through each of the aligned pairs of openings 38 in the upper and lower pairs of horizontal flanges 36 of connection angles 52. In this manner, several barges may be connected to one another in both side-by-side and end-to-end relationships while floating in a body of water to provide a substantially continuous horizontal surface, formed by the aligned upper support platforms 28 of the barges, for supporting construction equipment and/or other materials, for example.

In other embodiments, the connection angles 32 of the barges 20 may be configured without designated male and female ends. For example, the connection angles 32 on each side wall 24 of a pair of barges may be disposed at the same vertical distance with respect to one another, but may be staggered with respect to one another in a manner in which the horizontal flanges 36 at the upper and lower ends of the barges still overlap one another to facilitate the connections described above.

Figure 12:
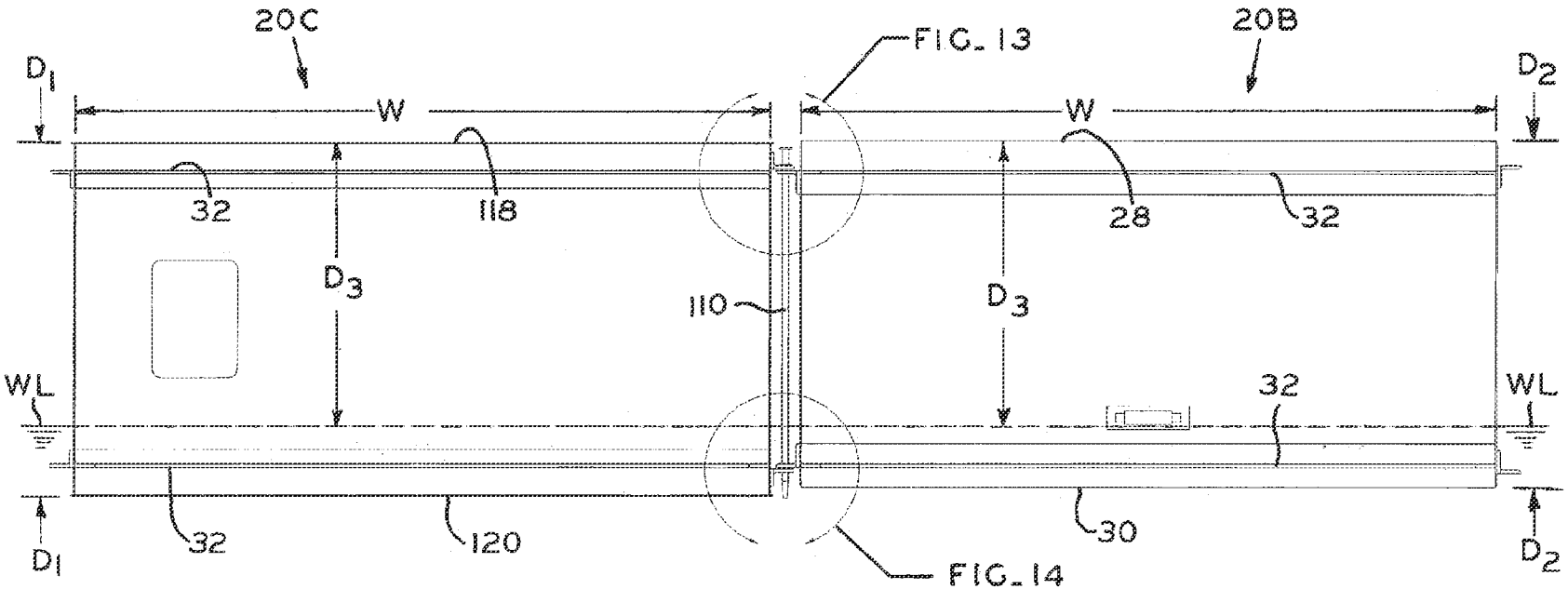
FIG. 12 is an end view of a barge in accordance with the present disclosure connected to a known barge in a side-by-side relationship while floating in a body of water.
Figure 13:
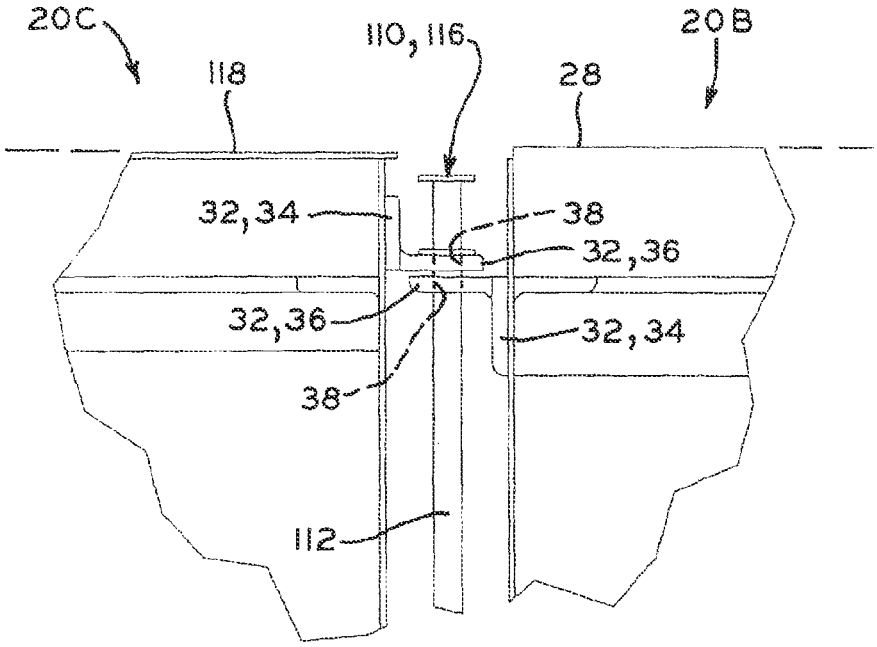
FIG. 13 is a fragmentary view of a portion of FIG. 12.
Figure 14:
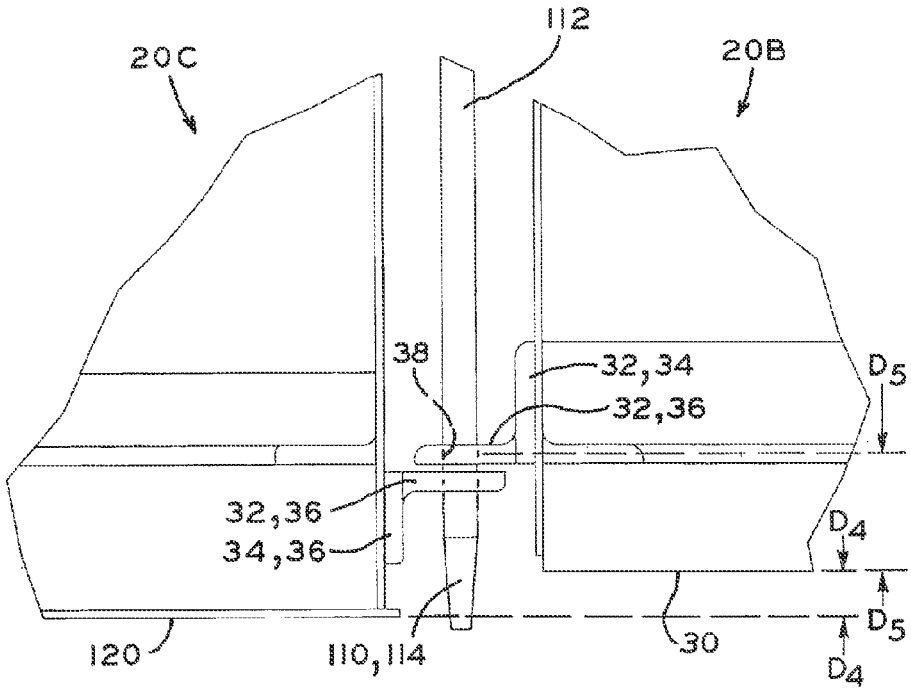
FIG. 14 is a fragmentary view of another portion of FIG. 12.

Referring to FIGS. 12-14, a further design aspect of the barge 20 according to the present disclosure is shown, which enables such barges to be functionally compatible with existing barges. FIG. 12 is an end view of a pair of barges, including a first, known barge 20C, shown to the left in FIG. 12, and a second barge 20B made in accordance with the present disclosure, shown to the right in FIG. 12. Barges 20B and 20C are shown in FIG. 12 connected to one another in a side-by-side relationship while floating in a body of water, with the waterline of the body of water indicated at WL with respect to the barges 20B and 20C.

The known barge 20C has an overall width dimension "W" of about 10 feet, an overall length dimension (not visible in FIG. 12) of about 41 feet, and an overall depth dimension "$D_1$" of 60.5 inches, and weighs at least 27,000 lbs. Barge 20C therefore displaces at least 27,000 lbs. of water and, based on a 27,000 lb. weight and the density of water at 62.4 lbs. per cubic foot, the total amount of water displaced by barge is 432.7 cubic feet.

Barge 20B made in accordance with the present disclosure includes the same overall width and length dimensions as barge 20C, though barge 20B, constructed as described above, is significantly lighter in overall weight as compared to the known barge 20C, weighing only 24,000 lbs. and displacing only 385 cubic feet of water. In one embodiment, barge 20B has a reduced overall depth dimension $D_2$ of 59.25 inches as compared to known barge 20C, as well as a configuration of connection angles 32 along its side and end walls 24 and 26 to allow barge 20B to be connected to barge 20C while floating in a body of water.

Specifically, returning to FIG. 12, barges 20C and 20B are shown connected to one another while floating in a body of water, with the waterline indicated at WL. In this configuration, as shown in FIGS. 12 and 13, top support platform 28 of barge 20B is level with the top support platform 118 of barge 20C while, as shown in FIGS. 13 and 14, connection angles 32 of barge 20B are properly aligned with corresponding connection angles 32 of barge 20C, with pins 110 received through the aligned openings 38 in the horizontal flanges 36 of the connection angles 32 as described above.

Also, because top support platform 28 of barge 20B is level with the top support platform 118 of barge 20C when the barges 20B and 20C are floating in a body of water in an unloaded state as shown in FIG. 12, the distance $D_3$ between each of the top support platforms 28 and 118 of barges 20B and 20C, respectively, and the waterline WL is the same. This distance $D_3$ between each of the top support platforms 28 and 118 of barges 20B and 20C, respectively, and the waterline WL, represents the effective loading capacity of the barges 20B and 20C and, when the barges are together loaded with construction equipment and/or materials, for example, the barges will displace the same amounts of additional water.

Notably, however, as shown in FIG. 12, although barges 20B and 20C float in a body of water with their top support platforms 28 and 118 aligned, the bottom platform 30 of barge 20B will be spaced upwardly a distance $D_4$ with respect to the bottom platform 120 of barge 20C, which corresponds to a difference in the depth dimension $D_1$ and $D_2$ between the barges 20B and 20C. Distance $D_4$ is at least 1 inch, and may be at least 1¼ inches, at least 1½ inches, or at least 1¾ inches, and arises from the fact that barge 20B, in weighing in one embodiment 24,000 pounds or less, displaces less water than barge 20C while also having a lesser overall depth dimension $D_2$ than the overall depth dimension $D_1$ of barge 20C.

A typical distance $D_5$ denoted in FIG. 14, between the centerline of horizontal flange 36 of connection angle 32 of barge 20B and the bottom platform 30 of barge 20B on the male side or end of barge 20B, is 4 inches or less, and may be 3.75 inches or less, 3.5 inches or less, or 3 inches or less, for example. The corresponding distance $D_5$ between the centerline of horizontal flange 36 of connection angle 32 of barge 20B and the bottom platform 30 of barge 20B on the female side or end of barge 20B, is 3 inches or less, and may be 2.75 inches or less, 2.5 inches or less, or 2 inches or less, for example.

The foregoing difference in displacement between barges 20B and 20C requires the arrangement of connection angles 32 of barge 20B to be specifically arranged as described above such that, when barges 20B and 20C are together floating in a body of water, the barges 20B and 20C may be connected to one another by moving the barges 20B and 20C into alignment with the connection angles 32 of the barges 20B and 20C smoothly overlapping with one another to allow the pins 110 to be received through the aligned openings 38 in the horizontal flanges 36 of the connection angles 32. Otherwise, the connection angles 32 of the barges 20B and 20C, if not properly located on barge 20B, would possibly contact one another, bending or otherwise deforming the connection angles 32 such that the barges 20B and 20C would not be connectable to one another while floating in a body of water.

Advantageously, the design of barge 20B allows barge 20B to be "backwardly compatible" with existing fleets of known barges 20C in a manner in which barges 20B may be connected to barges 20C while each are floating in a body of water with the top support platforms 28 and 118 of the barges 20B and 20C horizontally aligned with one another to provide a continuous horizontal surface for supporting construction equipment and/or other materials in the body of water. In this manner, contractors already in possession of an existing fleet of known barges 20C may acquire barges 20B in accordance with the present disclosure as desired and on an ongoing basis, and then easily and seamlessly connect barges 20B to the known barges 20C at a construction location.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A sectional barge assembly disposed within a body of water for supporting construction equipment, said barge assembly comprising:

a first barge having a body of a rectilinear configuration with two substantially vertical side walls and two substantially vertical end walls, a top support platform having a top surface, a bottom support platform having a bottom surface, a first vertical dimension defined between said top and bottom surfaces of said first barge, and at least one of said side walls and said end walls including an upper flange and a lower flange, said flanges vertically spaced from one another;

a second barge having a body of a rectilinear configuration with two substantially vertical side walls and two substantially vertical end walls, a top support platform having a top surface, a bottom support platform having a bottom surface, a second vertical dimension defined between said top and bottom surfaces of said second barge, said second vertical dimension less than said first vertical dimension, and at least one of said side walls and said end walls including an upper flange and a lower flange, said flanges vertically spaced from one another;

said first and second barges connected to one another with a pair of said upper and lower flanges of said first barge disposed in an overlapping relationship with a respective pair of said upper and lower flanges of said second barge and a plurality of pins extending through aligned openings in said flanges, said top surfaces of said first and second barges substantially horizontally aligned and said bottom surfaces of said first and second barges vertically spaced from one another by a distance of at least 1 inch.

2. The barge assembly of claim 1, wherein said bottom surfaces of said first and second barges are vertically spaced from one another by a distance of at least 1½ inches.

3. The barge assembly of claim 1, wherein:

said first barge has an overall width of about 10 feet, an overall length of about 41 feet, and a weight of at least 26,000 lbs; and said second barge has an overall width of about 10 feet, an overall length of about 41 feet, and a weight of less than 24,000 lbs.

4. The barge assembly of claim 1, wherein:

said first barge has an overall width of about 10 feet, an overall length of about 41 feet, and a weight of at least 26,500 lbs; and said second barge has an overall width of about 10 feet, an overall length of about 41 feet, and a weight of less than 23,500 lbs.

5. The barge assembly of claim 1, wherein said second barge further comprises:

a top support platform formed of a plurality of elongate sections each comprising a top surface and a bottom surface defining a thickness therebetween, and at least one tubular channel disposed between said top and bottom surfaces;

a bottom support platform formed of a plurality of elongate sections each comprising a top surface and a bottom surface defining a thickness therebetween, and at least one tubular channel disposed between said top and bottom surfaces.

6. The barge of claim 1, wherein a distance between a centerline of said lower flange of said second barge and said bottom surface of said second barge is 4 inches or less.

7. The barge of claim 6, wherein said distance between a centerline of said lower flange of said second barge and said bottom surface of said second barge is 3.5 inches or less.

8. The barge of claim 7, wherein said distance between a centerline of said lower flange of said second barge and said bottom surface of said second barge is 3 inches or less.

9. The barge of claim 1, wherein said top support platform of said second barge is formed of a plurality of elongate sections each comprising a top surface and a bottom surface defining a thickness therebetween, with at least one tubular channel disposed between said top and bottom surfaces;

a bottom support platform of said second barge is formed of a plurality of elongate sections each comprising a top surface and a bottom surface defining a thickness therebetween, with at least one tubular channel disposed between said top and bottom surfaces.

10. The barge of claim 9, wherein said elongate sections comprise roll-formed metal sections connected along a plurality of joints, each joint including a projection of one of said elongate sections received within a recess of another of said elongate sections.

11. A method of assembling a sectional barge assembly in a body of water for supporting construction equipment, said method comprising the steps of:

providing, in a body of water:

a first barge having a body of a rectilinear configuration with two substantially vertical side walls and two substantially vertical end walls, a top support platform having a top surface, a bottom support platform having a bottom surface, a first vertical dimension defined between the top and bottom surfaces of the first barge, and at least one of the side walls and the end walls including an upper flange and a lower flange, the flanges vertically spaced from one another; and a second barge having a body of a rectilinear configuration with two substantially vertical side walls and two substantially vertical end walls, a top support platform having a top surface, a bottom support platform having a bottom surface, a second vertical dimension defined between said top and bottom surfaces of the second barge, the second vertical dimension less than the first vertical dimension, and at least one of the side walls and the end walls including an upper flange and a lower flange, the flanges vertically spaced from one another;

moving the first and second barges adjacent one another with the top surfaces of the first and second barges substantially horizontally aligned and the bottom surfaces of the first and second barges vertically spaced from one another by a distance of at least 1 inch, and a pair of upper and lower flanges of the first barge disposed in an overlapping relationship with a respective pair of upper and lower flanges of the second barge; and connecting the first and second barges to one another.

12. The method of claim 11, wherein said connecting step further comprises inserting a plurality of pins through aligned openings in the flanges.

13. The method of claim 11, wherein said providing step further comprises:

providing the first barge having an overall width of about 10 feet, an overall length of about 41 feet, and a weight of at least 26,000 lbs; and providing the second barge having an overall width of about 10 feet, an overall length of about 41 feet, and a weight of less than 24,000 lbs.

14. The method of claim 11, wherein said providing step further comprises:

providing the first barge having an overall width of about 10 feet, an overall length of about 41 feet, and a weight of at least 26,500 lbs; and providing the second barge having an overall width of about 10 feet, an overall length of about 41 feet, and a weight of less than 23,500 lbs.

15. The method of claim 11, wherein a distance between a centerline of the lower flange of the second barge and the bottom surface of the second barge is 4 inches or less.

16. The method of claim 15, wherein the distance between a centerline of the lower flange of the second barge and the bottom surface of the second barge is 3.5 inches or less.

17. The method of claim 16, wherein the distance between a centerline of the lower flange of the second barge and the bottom surface of the second barge is 3 inches or less.

18. The method of claim 11, wherein the second barge further comprises:

a top support platform formed of a plurality of elongate sections each comprising a top surface and a bottom surface defining a thickness therebetween, and at least one tubular channel disposed between the top and bottom surfaces;

a bottom support platform formed of a plurality of elongate sections each comprising a top surface and a bottom surface defining a thickness therebetween, and at least one tubular channel disposed between the top and bottom surfaces.

19. The method of claim 18, wherein the elongate sections comprise roll-formed metal sections connected along a plurality of joints, each joint including a projection of one of the elongate sections received within a recess of another of the elongate sections.

* * * * *